United States Patent [19]

Szerlag et al.

[11] Patent Number: 5,029,917

[45] Date of Patent: Jul. 9, 1991

[54] PLASTIC AND METAL DOOR HANDLE ASSEMBLY

[75] Inventors: Donald Szerlag, Canton; Joseph E. Mishark, Rochester Hills; James D. Girard, St. Clair Shores, all of Mich.

[73] Assignee: General Motors Corporation, Detroit, Mich.

[21] Appl. No.: 549,301

[22] Filed: Jul. 9, 1990

[51] Int. Cl.[5] ..... E05C 21/00

[52] U.S. Cl. ..... 292/347; 292/DIG. 37; 292/DIG. 38

[58] Field of Search ..... 292/347, 336.3, DIG. 37, 292/DIG. 38; 16/116 R, 124

[56] References Cited

U.S. PATENT DOCUMENTS

| | | | |
|---|---|---|---|
| 1,634,342 | 7/1927 | Shinkez | 292/347 |
| 3,162,374 | 12/1964 | Skokut | 292/DIG. 38 X |
| 3,604,230 | 9/1971 | Tixier | 292/DIG. 37 X |
| 3,677,591 | 7/1972 | Waldo | 292/DIG. 37 X |
| 4,232,892 | 11/1980 | Kuki | 292/347 |
| 4,803,755 | 2/1989 | Pohlman | 16/116 |
| 4,886,310 | 12/1989 | Cyr et al. | 292/DIG. 37 X |

*Primary Examiner*—Richard E. Moore

*Attorney, Agent, or Firm*—Charles E. Leahy

[57] ABSTRACT

The die cast metallic door handle adapted for attachment on the vehicle door has a molded plastic insert attached thereto on the face thereof facing toward the vehicle so that a user gripping the door handle places his fingers against the molded plastic insert to insulate his fingers from the temperature of the metallic handle. In addition, a molded plastic push button assembly including a molded plastic housing and a molded plastic push button are attached to the metallic handle so that the user's thumb pushes against the molded plastic push button instead of a metallic handle. In addition, the push button assembly has the molded plastic push button slidably guided on a pin which is encircled by a spring acting to position the push button. The push button assembly may be preassembled prior to its attachment to the handle so that push button assembly may be pretested prior to attachment to the handle.

1 Claim, 1 Drawing Sheet

PLASTIC AND METAL DOOR HANDLE ASSEMBLY

The invention relates to a push button door handle for a motor vehicle and more particularly provides a door handle assembly having a metallic handle finished to enhance the vehicle appearance and a molded plastic grip insert and push button which insulate the user's hand from temperature extremes affecting the metallic handle.

BACKGROUND OF THE INVENTION

It is well known in motor vehicles to provide a door handle assembly gripped by the user to open the vehicle door. Such a door handle assembly includes a push button which is depressed by the user and suitably coupled to a door latch so that depressing the push button releases the door latch.

Push button door handles are conventionally of metallic die cast construction and are typically painted or chrome plated to enhance the appearance of the vehicle. A disadvantage of such metallic door handles is that the user may experience some discomfort in gripping the metallic door handle because the handle is affected by high temperature and low temperature extremes.

BRIEF DESCRIPTION OF THE EMBODIMENT

According to the present invention, the die cast metallic door handle adapted for attachment on the vehicle door has a molded plastic insert attached thereto on the face thereof facing toward the vehicle so that a user gripping the door handle places his fingers against the molded plastic insert to insulate his fingers from the temperature of the metallic handle. In addition, a molded plastic push button assembly including a molded plastic housing and a molded plastic push button are attached to the metallic handle so that the user's thumb pushes against the molded plastic push button instead of a metallic handle. In addition, the push button assembly has the molded plastic push button slidably guided on a pin which is encircled by a spring acting to position the push button. The push button assembly may be preassembled prior to its attachment to the handle so that push button assembly may be pretested prior to attachment to the handle.

Accordingly, the object, feature and advantage of the invention resides in the provision of a metallic door handle having plastic grip insert and push button so that those portions of the door handle assembly touched by the user are of molded plastic construction thereof insulating the user from the temperature extremes experienced by the metallic door handle.

A further object, feature and advantage of the invention resides in the provision of a molded plastic door handle assembly including a spring loaded push button preassembled to a push button housing to enable testing of the push button assembly prior to attachment onto the metallic door handle.

BRIEF DESCRIPTION OF THE DRAWINGS

These and other objects, features and advantages of the invention will become apparent upon consideration of the description of the preferred embodiment and the appended drawings in which.

DESCRIPTION OF THE PREFERRED EMBODIMENT

Figure 1:
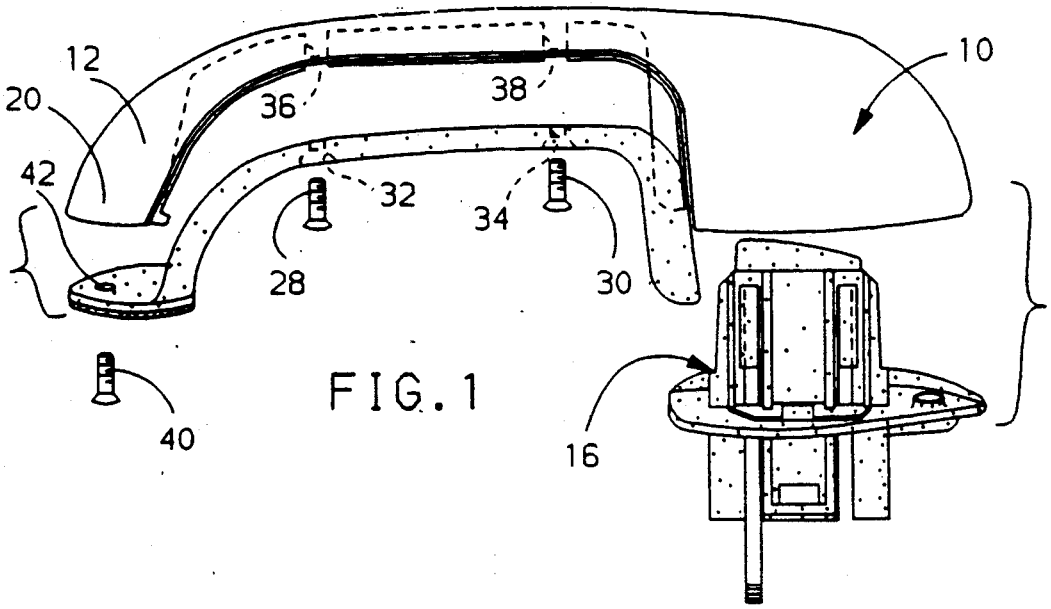
FIG. 1 is an exploded view showing the door handle assembly prior to assembly.

Referring to FIG. 1, it is seen that the door handle assembly generally indicated at 10 is shown in unassembled condition and includes a die cast metallic door handle 12, a molded plastic handle insert 14 and a molded plastic push button assembly, generally indicated at 16.

Figure 2:
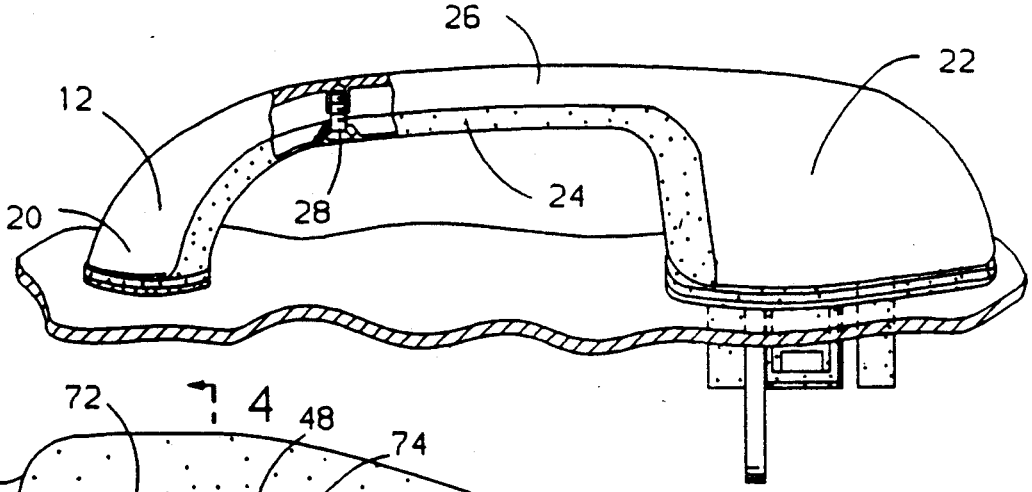
FIG. 2 is a plan view of the door handle assembly having parts broken away and in section.

FIG. 2 shows the grip insert 14 and the push button assembly 16 assembled to the door handle 12.

As best seen in FIGS. 1 and 2, the metallic door handle 12 includes spaced apart ends 20 and 22 which are adapted for attachment to the vehicle door 23 by screws or the like, not shown. The door handle also includes a grip portion 24 which connects the ends 20 and 22 and faces towards the vehicle door and is spaced therefrom to define a space into which the vehicle user may insert his hand to grip the handle 12. In addition, the door handle 20 includes a finished portion 26 which faces outwardly away from the door and is appropriately chrome plated, painted or otherwise finished to the enhance the appearance of the vehicle.

The molded plastic grip insert 14 is constructed of a suitable molded plastic and is shaped to fit inside the grip portion 24 of the metallic handle 12. A pair of screws 28 and 30 are installed through apertures 32 and 34 molded in the grip insert 14 and are threaded into threaded bosses 36 and 38 formed on the handle 12. In addition, a push pin 40 is installed through aperture 42 in the grip insert and into the end 20 of handle 12.

Figure 3:
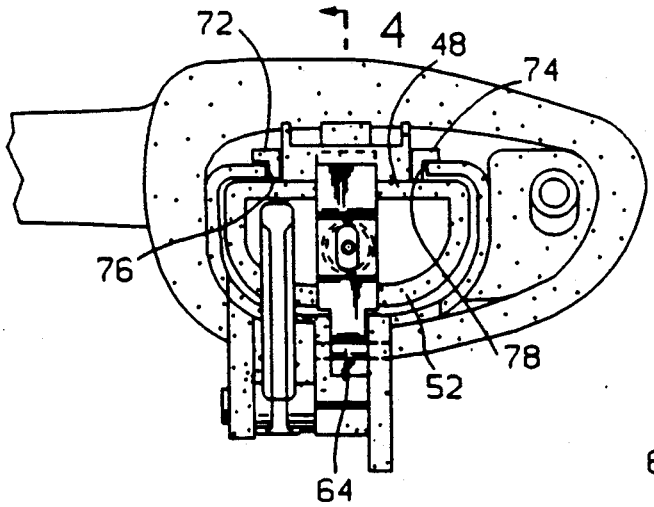
FIG. 3 is a fragmentary elevation view of the door handle assembly.
Figure 4:
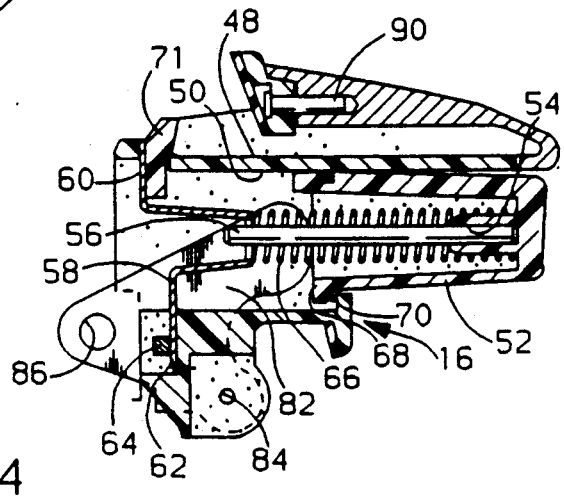
FIG. 4 is a sectional view taken in the direction of arrows 4—4 of FIG. 3 showing the plastic push button assembly.

As best seen in FIGS. 3 and 4, the push button assembly 16 includes a molded plastic housing 48 which defines a barrel 50 into which the molded plastic push button 52 may be inserted through the left-hand end of the barrel 50 as viewed in FIG. 4. The right-hand end of the interior of push button 52 has a recess 54 which receives a pin 56. A spring retainer 58 of stamped metal construction includes an upper end 60 which is inserted into a slot of the push button housing 48 and a lower end 62 which is retained by a retainer pin 64. A coil compression spring 66 encircles the pin 56 and acts between the push button 52 and the spring retainer 58 so that the spring 66 acts to bias the push button 52 to the normal extended position shown in FIG. 4 in which a tab 68 extending downwardly from the bottom of push button 52 engages with a shoulder 70 of housing 48. A spacer 71 is inserted between the housing 48 and the upper leg 60 of spring retainer 58.

As best seen in FIGS. 1 and 3, push button 52 has integrally molded C-shaped flanges 72 and 74 which extend through slots 76 and 78 molded in the housing 48 to slidably mount the push button 52 on the housing 48.

The push button assembly 16 also includes an operating lever 82 which is pivoted on the housing 48 by a pin 84 and has an aperture 86 adapted to receive a rod connected to the door latch.

It will be understood that the push button assembly 16, including the housing 48, push button 52, pin 56, retainer 58, spacer 71 and lever 82 are assembled and tested as a unit in order to assure proper functioning of the push button assembly 16. Subsequent to this testing of the push button assembly 16, the push button assembly 16 is attached to the door handle 12 by one or more push pins 90 acting between the housing 48 and the handle 12.

Thus is it seen that the invention provides a new and improved door handle assembly having a handle grip insert and push button of molded plastic which insulate the user's hand from the temperature extremes experienced by the metallic door handle. In addition, it will be appreciated that the molded plastic door handle assembly 16, including the pin 56 and spring 66 and retainer 53 may be assembled to enable testing prior to attachment to the door handle.

The embodiments of the invention in which an exclusive property or privilege is claimed are defined as follows:

1. A vehicle door handle comprising:

a metallic handle adapted for attachment on the vehicle door and having a grip portion facing inwardly toward the door and a finished portion facing outwardly of the door;

a molded plastic grip insert attached to the inwardly facing grip potion to be gripped by a vehicle user;

and a molded plastic pushbutton assembly adapted for attachment to the metallic handle and including a plastic housing, a pin carried by the plastic housing to movably mount and slidably guide the plastic pushbutton, and a spring means encircling the pin and acting between the plastic housing and the plastic pushbutton so that the pushbutton may be assembled and tested prior to attachment thereof to the metallic handle.

* * * * *